United States Patent [19]

White

[11] Patent Number: 4,534,609

[45] Date of Patent: Aug. 13, 1985

[54] ELECTRICAL CONNECTOR BLOCK

[75] Inventor: Johnnie W. White, Streamwood, Ill.

[73] Assignee: Bally Midway Mfg. Co., Franklin Park, Ill.

[21] Appl. No.: 524,987

[22] Filed: Aug. 22, 1983

[51] Int. Cl.[3] ..... H01R 13/52

[52] U.S. Cl. ..... 339/117 R; 339/112 L

[58] Field of Search ..... 339/112 R, 112 L, 117 R, 339/117 P, 198 R, 17 C, 17 LC; 228/180 R

[56] References Cited

U.S. PATENT DOCUMENTS 3,665,375 5/1972 Thoms et al. ..... 339/112 R X

FOREIGN PATENT DOCUMENTS 2842892 4/1979 Fed. Rep. of Germany .... 339/17 C 1402895 5/1965 France ..... 339/112 R

*Primary Examiner*—Eugene F. Desmond

*Attorney, Agent, or Firm*—Robert E. Wagner; Leo J. Aubel; Ralph R. Rath

[57] ABSTRACT

A multi-terminal connector unit includes a block having a plurality of spaced terminal pins extending from a surface thereof and each terminal pin is surrounded by a socket that extends to an opposite surface of the block. The bottom of each socket has at least one opening extending to the adjacent surface of the block to provide a flow-through or drain path for cleaning liquid used to clean the socket and associated PC board.

8 Claims, 5 Drawing Figures

ELECTRICAL CONNECTOR BLOCK

DESCRIPTION

1. Technical Field

The present invention relates generally to an electrical connector, generally of the type that has multiple pin terminals therein.

2. Background Prior Art

Mateable electrical connector blocks or sockets which house multiple electrical terminal pin connectors are well known in the art. One presently known type of terminal connector socket consists of a main body that has a base with a plurality of spaced terminal pins extending from the base and into the main body. The main body has an elongated recess extending from the base to an opposed surface around each of the terminal pins which defines a female socket surrounding the terminal pin. In the manufacture and assembly of this type of connector block, it is customary to mold the block from a plastic material and concurrently provide support means for each of the terminal pins, which are subsequently assembled thereto. The support means for the terminal pins consists of a center post that is centrally-located within each recess and has an aperture extending therethrough for receiving the terminal pin. Usually the terminal pin is press-fitted into the aperture and is frictionally-retained. Such connector blocks or sockets are frequently used for or as, printed circuit (PC) board connectors. As is known, PC boards are normally soldered by wave soldering, and a final phase or cycle of the soldering process includes a wash cycle. The sockets or connector blocks which may have been soldered to the PC board may fill up with liquid, i.e. water during the wash cycle with the attendant problem of insuring the connector block is drained and dried.

SUMMARY OF THE INVENTION

According to the present invention, the terminal blocks of the prior art are modified to provide a flow-through system which will prevent water from accumulating in or filling-up the connector block.

More specifically, the multi-terminal connector unit consists of a main body that has a base portion with a plurality of sockets or recesses extending from the base portion to an opposed surface of the terminal block. A terminal pin extends through the base into the base or bottom of each of the sockets or recesses and the main base portion has at least one opening extending from the bottom of the socket so that any cleaning liquid that is introduced into the top of the open end of the socket can drain through the drain openings.

In the specific embodiment, the terminals are supported on a post integral with the base portion and extending partially into the base of the socket or the recess. In the preferred form, there are a plurality of circumferentially-spaced openings extending from each of the sockets or recesses and the openings are equally spaced about the center post. Thus, the openings provide a fluid path for allowing cleaning fluid to be introduced into the open end of the socket and still drain out.

BRIEF DESCRIPTION OF SEVERAL VIEW OF DRAWINGS

DETAILED DESCRIPTION

Figure 1:
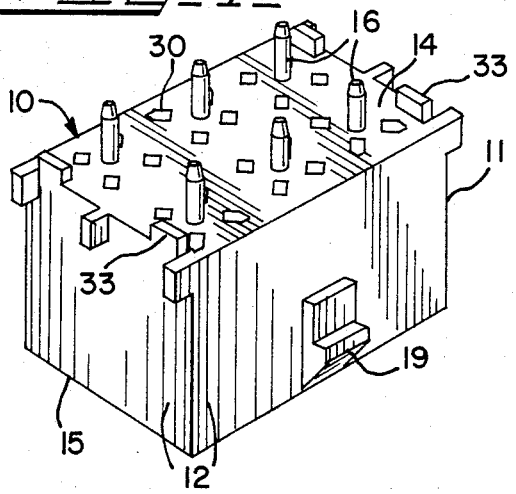
FIG. 1 shows a perspective view of the electrical terminal unit.

While this invention is susceptible of embodiment in many different forms, there is shown in the drawings and will herein be described in detail a preferred embodiment of the invention with the understanding that the present disclosure is to be considered as an exemplification of the principles of the invention and is not intended to limit the broad aspect of the invention to the embodiment illustrated.

FIG. 1 of the drawings discloses a multi-terminal connector socket or insulator block, generally designated by reference numeral 10. The insulator block 10 comprises a rectangular box-like member 11 having four sides generally labeled 12, a base 14 and an open or male plug receiving end 15. Base 14 supports a plurality of pins 16 in spaced side-by-side relation. Any number of such pins can be incorporated into the insulator block, and six have been shown for illustrative purposes.

Figure 3:
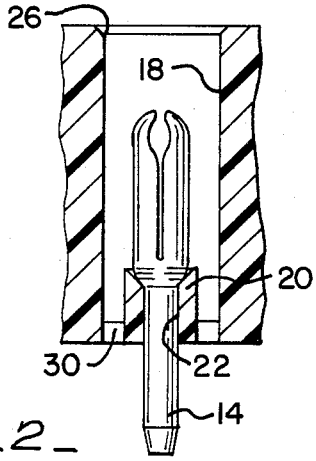
FIG. 3 is a cross-sectional view through one of the sockets, as viewed along line 3—3 of FIG. 2.
Figure 5:
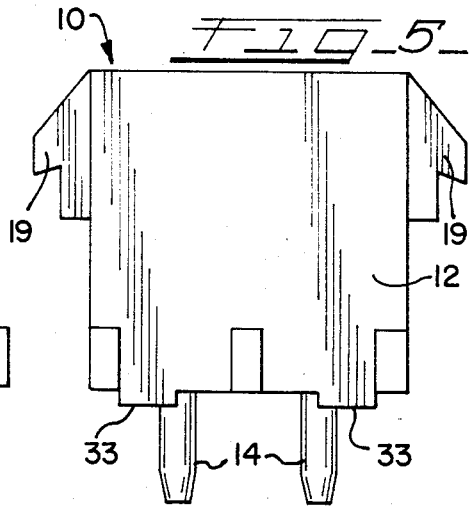
FIG. 5 is an end view of the terminal block.

The connector member 11 is preferably molded from a plastic material and with base 14 as an integral part thereof. Base 14 includes a plurality of apertures respectively surrounding the pins 16 which define individual elongated female sockets 18 (see FIGS. 3 and 5) surrounding each of the pins 16. The sockets 18 may be formed to key with, and accept, the associated male socket block member, not shown. The commercial unit of this type also incorporates an integral latching mechanism 19 for interconnecting an adjacent pair of connector block assemblies.

The respective terminal pins 16 are supported in support means consisting of a center post 20 that has an aperture 22 extending therethrough and is located in the center of the respective socket 18 that surrounds each of the pins 16.

As indicated above, in the manufacture of the electrical terminal insulator block 10, the connector member 11 is initially molded from a plastic material as a one-piece unit. The terminal pins are then installed by being forcibly inserted into the aperture 22 in the center post 20. Thereafter, mating wires may be connected to the terminal pins.

As mentioned above, the subject connector blocks are often used as PC board connectors. PC boards are normally soldered by wave soldering which normally includes a wash cycle to remove foreign or extraneous particles and matter and generally clean the board. Obviously any foreign particles on the PC board, or in the connector, or liquid or water in the connector block may interfere with making proper electrical connection in the field or may short across the pins.

In the prior art-type of connector block, the connector member or body 11 is enclosed by the base 14 so that any water or foreign particles that collect in the recess or sockets 18 must be removed through the inlet opening 26 for the socket. As explained above, this makes it difficult to drain the water and remove small particles from of the connector block after assembly.

According to the present invention, the problems of the prior art-type of construction have been alleviated by providing a flow-through system for the water or cleaning fluid that is utilized to clean the assembly.

Figure 2:
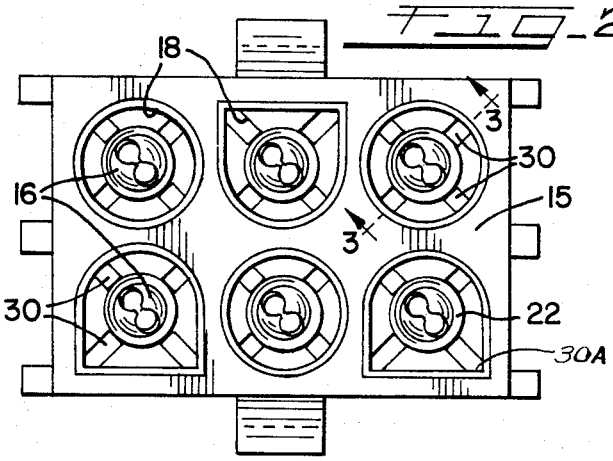
FIG. 2 is a bottom plan view of the terminal block.
Figure 4:
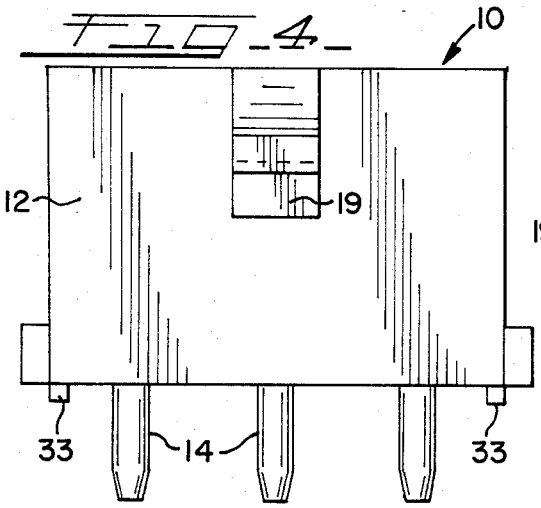
FIG. 4 is a side view of the terminal block.

As illustrated in the drawings, the base or end wall 14, which was heretofore an integral unit extending entirely across the block, has a plurality of openings 30 formed therein and in communication with the opening at the open end 26 of the socket. As illustrated in FIG. 2, there are a similar number of openings 30 around each of the center posts 20 and the openings are spaced around the perimeter of the center post 20. In the embodiment shown, the openings 30 are generally rectangular in cross-section, and selected ones of the opening 30 have an end which extends angularly to a point as at 30A. In the preferred embodiment, four openings are formed around each center post equally spaced approximately 90° from each other.

Of course, the number, size and shape of the drain openings can vary and will depend upon the size of the block assembly and the number and size of the sockets.

The opening arrangement disclosed herein allows for any cleaning fluid to be introduced into the inlet end 26 of socket 24 and flow through the openings 30 thereby allowing the socket to empty of liquid and the liquid to carry any foreign matter that may collect in the socket during the assembly process. Various stand offs or supports generally labeled 33 extend downwardly from the base 14 to maintain a spacing between the base 14 and the associated PC board whereby drainage between the base 14 and the PC board is assured.

To summarize, and as can be appreciated from the above description, the present invention provides a connector block having a perforated end wall thereby obtaining a liquid flow-through system for connector blocks. The flow-through system assures that the cleaning liquid flows out of the sockets, and provides a means of assuming that any foreign particles are removed from the socket.

While the invention has been particularly shown and described with reference to a preferred embodiment thereof, it will be understood by those skilled in the art that various changes in form and details may be made therein without departing from the spirit and scope of the invention.

I claim:

1. A multi-terminal connector block comprising a body member having a plurality of openings or sockets extending from a surface thereof and terminating short of an opposed surface to define a base wall, support means on said base wall in each of said sockets for supporting a terminal pin in each socket, said base wall having openings extending therethrough to provide a liquid flow-through system whereby any liquid utilized as a cleaning agent will drain out and not accumulate in the sockets.

2. A multi-terminal connector as defined in claim 1, in which each support means includes a center post integral with said base wall and having an aperture for receiving the terminal pin and in which there are a plurality of openings surrounding said post in each of said sockets.

3. A multi-terminal connector as defined in claim 2, in which said openings are equally spaced around said center post.

4. A multi-terminal connector as defined in claim 2, wherein said base wall includes downwardly depending stand offs to assure said base is spaced from the associated mounting to assure drainage from said sockets.

5. An electrical terminal unit comprising a generally box-like main body with an open top, said body having an integral base with a plurality of spaced terminal pins extending through said base and sockets surrounding each terminal pin and extending to an opposed surface of said main body, the improvement of means defining openings in said base extending from the bottoms of each of said sockets to provide a flow-through path for cleaning fluid.

6. An electrical terminal unit as defined in claim 5, in which there are a plurality of equally-spaced openings extending from each of said sockets.

7. A multi-terminal connector unit including first wall means defining a block-like base portion, a second wall means integral with said first wall means and defining a plurality of elongated side-by-side recesses, support means on said first wall means in each of said recesses for supporting a connector pin, and opening means extending from each of said recesses to allow any liquid accumulated in said recesses to drain.

8. A multi-terminal connector unit as defined in claim 7, in which said opening means consists of a plurality of openings extending from each recess.

* * * * *